United States Patent [19]

Hodroski, Jr.

[11] Patent Number: 4,713,846

[45] Date of Patent: Dec. 22, 1987

[54] FOOT REST FOR TOILET

[76] Inventor: Frank S. Hodroski, Jr., R.D. 5, Box 24 A, Jackson, N.J. 08527

[21] Appl. No.: 872,669

[22] Filed: Jun. 10, 1986

[51] Int. Cl.[4] ..... E03D 11/00

[52] U.S. Cl. ..... 4/254; 4/661

[58] Field of Search ..... 4/254, 661

[56] References Cited

U.S. PATENT DOCUMENTS

| | | | |
|---|---|---|---|
| 1,798,632 | 3/1931 | Romer | 4/254 |
| 2,023,901 | 12/1935 | Rhodes | 4/254 |
| 4,244,064 | 1/1981 | Parr | 4/254 |

FOREIGN PATENT DOCUMENTS

| | | | |
|---|---|---|---|
| 463664 | 8/1928 | Fed. Rep. of Germany | 4/254 |
| 508641 | 7/1939 | United Kingdom | 4/254 |

*Primary Examiner*—Henry K. Artis

*Attorney, Agent, or Firm*—Mitchell P. Novick

[57] ABSTRACT

A toilet foot rest to facilitate a toilet user assuming a semi-squatting position during use. The foot rest comprises a light-weight hollow structure that fits under and around the base of the toilet. The foot rest slopes downward from the front to the back. The top surface of the foot rest may be covered with a non-slip material. The user may switch between utilizing and not utilizing the foot rest without rising from the toilet by sliding the foot rest out from under the toilet or back under the toilet, respectively. The foot rest may also be used by children or other persons whose legs do not reach the floor when using the toilet.

5 Claims, 4 Drawing Figures

FOOT REST FOR TOILET

BACKGROUND OF THE INVENTION

This invention relates to toilets and, more particularly, to devices that control the position of a person sitting on a toilet.

It is well known that the toilet construction currently in use in the western world, including both the toilet bowls and the toilet seats, are not designed to take full advantage of the toilet user's physiological functions. Current toilet construction usually comprises a bowl attached to an inwardly sloping support and a seat of generally horizontal orientation. In brief, the shape of conventional toilets significantly interferes with blood circulation in the user's legs. Furthermore, the user's sitting position while on the toilet tends to compress the user's buttocks, thereby hampering the elimination process. It is significant that poor blood circulation and strain are among the leading causes of the painful condition of hemorrhoids.

Various studies regarding the toilet and elimination process have suggested that to maximize elimination efficacy and minimize strain on the toilet user, the user should assume a semi-squat position on the toilet. In this position, the user's thigh muscles, resting against the upper groin area, can result in the elimination of a larger percentage of excrement in the body.

In addition, the conventional toilet is made of a size to suit the average adult person. Thus, the conventional toilet is difficult to use by small children or other persons with very short legs. The short legs tend not to reach the ground and dangle unsupported. The person may experience discomfort or insecurity due to his dangling legs while using the toilet.

The prior art comprises sculpted toilet seats and foot rests from the toilet user. The sculpted toilet seats, which replace conventional seats, have elevated and depressed portions arranged so that (1) the user's buttocks is left uncompressed or (2) the user is urged to lean forward during the elimination process, in either case, the user relieves some of the strain otherwise encountered during the elimination process. Alternatively, the foot rests are either permanently attached to the toilet bowl support or temporarily hooked over the upper lip of the toilet bowl, usually between the existing seat and the bowl.

The prior art devices have three major drawbacks. First, those devices that are permanently attached to the toilet do not allow for use of that toilet in a conventional manner by persons who prefer the conventional toilet setup. Second, the detachable devices need a place for storage and often require more time to set up than is available when a person needs to use the toilet. Third, the devices in general are visually unattractive or intimidating to the user.

In addition, the sculpted toilet seats do not alleviate the leg dangling of small children or other persons with very short legs.

SUMMARY OF THE INVENTION

A primary object of the instant invention is a foot rest that will allow the toilet user to assume a semi-squat position during elimination.

Another object of the instant invention is a foot rest for toilets that can be used as a foot support by small children or other persons having very short legs.

Another object of this invention is a foot rest for toilets that permits the toilet to be used interchangeably as a conventional toilet or with the foot rest, such changes being easily accomplished at any time during use of the toilet.

Another object of this invention is a foot rest for toilets that is easily stored.

Another object of this invention is a foot rest for toilets that is visually attractive.

Another object of this invention is a foot rest for toilets that is safe and can be put into use by a small child.

Another object of this invention is a foot rest for toilets that is easily cleaned.

Briefly, this invention comprises a sloped foot rest that is shaped so that is may be stored under a conventional toilet bowl. The foot rest may be slid out from under the toilet to use it or back under the toilet to store it.

DESCRIPTION OF PREFERRED EMBODIMENT

Figure 1:
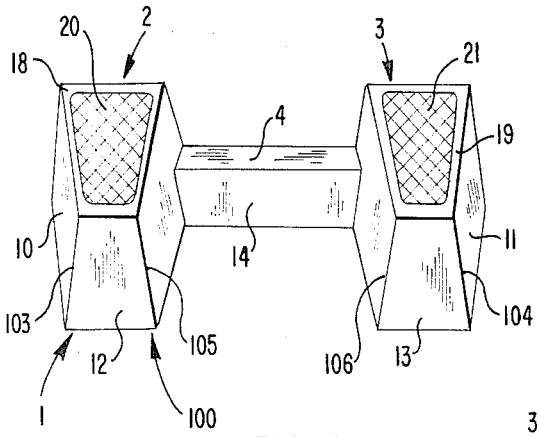
FIG. 1 is a perspective view of a foot rest from above and behind the foot rest.
Figure 2:
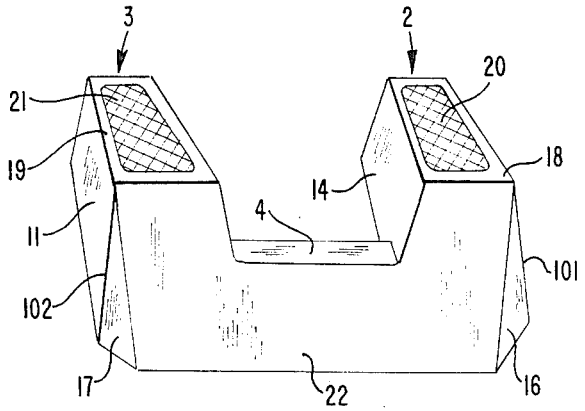
FIG. 2 is a perspective view of the foot rest shown in FIG. 1 from above and in front of the foot rest.
Figure 3:
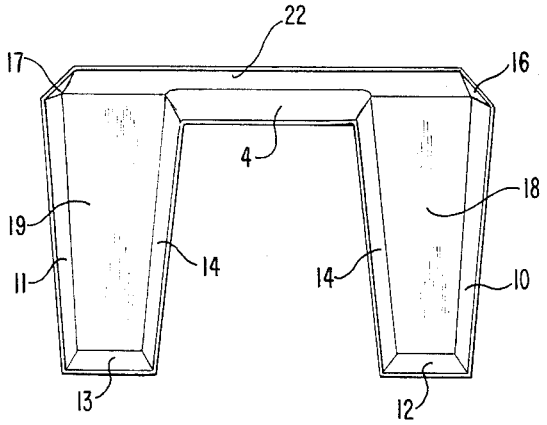
FIG. 3 is a bottom view of the foot rest shown in FIG. 1.
Figure 4:
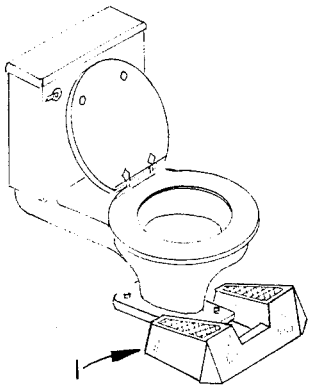
FIG. 4 is a view of the foot rest shown in FIG. 1 in use with a toilet.

A preferred embodiment of the foot rest 1 comprises a hollow, foot rest of generally unitary construction. The foot rest is a generally U-shaped trough 100 as follows: The outer wall of the trough 100 comprises two generally trapezoidal outer sides 10, 11 relatively parallel to each other with corresponding front edges 101, 102, respectively, and back edges 103, 104, respectively; a generally trapezoidal outer front 22 positioned between the outer sides 10, 11 generally along the plane containing the front edges 101, 102; and two generally trapezoidal front connecting sections 16, 17, front connecting section 16 attached to the front edge 101 and the corresponding edge of outer front 22, and front connecting section 17 attached to the front edge 102 and the corresponding edge of outer front 22. The inner wall of the trough comprises a generally U-shaped inner side 14 positioned so that the open edges of the "U" lie generally along the plane containing the back edges 103, 104. The outer wall and inner wall of the trough 100 are joined together by two generally trapezoidal back connecting sections 12, 13 generally along the plane containing the outer wall's back edges 103, 104 and the inner wall's open edges 105, 106, back connecting section 12 attached to the back edge 103 and the corresponding open edge of inner wall 14, and back connecting section 13 attached to the back edge 104 and the corresponding open edge of inner wall 14. The trough 100 is totally closed on top by generally flat top surface 2 attached along its edges to outer edge 10, connecting sections 12, 16, and portions of front 22 and inner wall 14; generally flat top surface 3 attached along its edges to outer edge 11, connecting sections 13, 17, and portions of front 22 and inner wall 14; and generally U-shaped surface 4 attached along its edges to portions of top surfaces 2, 3, front 22, and inner wall 14.

The trough 100 is open at the bottom. The trough 100 flares out in all directions from its top to its open bottom. This flaring promotes additional stability during use. The U-shaped surface 4 extends in depth from the trough top to trough bottom; this provides a generally U-shaped opening which may accommodate the expanding outer surface of the front of the standard toilet bowl. Top surfaces 2, 3 slope downward from the front of the foot rest 1 to the back of the foot rest 1. In addition, top surfaces 2, 3 are covered with non-slip pads 20, 21, respectively.

The foot rest 1 is employed as follows: For storage, or for the user who wishes to use the toilet without the foot rest 1, the foot rest 1 is pushed under the toilet bowl as far as possible. The "U" shaped of the trough allows for the foot rest 1 to be placed around the toilet bowl; the "U" shape of surface 4 allows the foot rest 1 to slip under the vertically expanding portion of the toilet bowl. Thus, the foot rest 1 remains virtually completely underneath the standard toilet when not in use.

In use, the foot rest 1 is slid out from its storage position underneath the toilet to a position at which the user can comfortably place his feet upon the top surfaces 2, 3 and securely because of the non-slip pads 20, 21. Because the top surfaces 2, 3 are sloped, the user may adjust the position of the foot rest 1 until the height of the point of contact between the user's feet and the foot rest 1 allows for maximum comfort. For the user with short legs or a small child, the foot rest 1 thereby provides a solid surface for placing his feet and eliminates the unsupported dangling of his legs during use of the toilet. For other purposes, use of the foot rest 1 forces the toilet user into a semi-squat position. This position promotes more comfortable and more complete elimination.

Due to the foot rest's light weight and ability to be used or not used by merely sliding it back and forth from underneath the toilet, the user may adjust the height of the contact point even during use of the toilet. Furthermore, the user may even switch between using the toilet with the foot rest 1 and without the foot rest 1 during a single use of the toilet and without having to rise from the toilet. Such sliding may be accomplished by the user's hands or feet.

The foot rest 1 is preferably manufactured from relatively inexpensive plastics. Consequently, the foot rest 1 may be manufactured in a variety of colors that allow the foot rest 1 to blend into the decor of the bathroom. In addition, the foot rest 1 is made without any sharp edges and is therefore safe for use by small children. Finally, the foot rest 1 made be cleaned as easily as any other bathroom surface.

Although the foot rest has been described with a certain degree of particularity, it is to be understood that the present disclosure has been made only by way of illustration and that numerous changes in the details of construction and arrangement of parts may be resorted to without departing from the spirit and scope of this invention.

I claim:

1. A foot rest for use with a toilet, said toilet comprising a bowl and a base on which said bowl rests, said foot rest comprising:

an inverted trough comprising:

a top surface having two extremities and a middle; and two side walls connected to said top surface, said trough having a generally U-shaped cross-section, said trough further being hollow and shaped to define a generally U-shaped opening for receiving said base, said opening being sufficiently large so that said foot rest may be moved relative to said base when said opening so receives said base, and so that said foot rest may be so moved to a position substantially completely underneath said toilet, said foot rest being composed of a light-weight material;

said foot rest being slidably adjustable during use of said toilet.

2. A foot rest as described in claim 1, wherein said top surface slopes downward from said middle towards each of said extremities.

3. A foot rest as described in claim 2, wherein said side walls have an outward taper from top to bottom.

4. A foot rest as described in claim 1, further comprising non-slip means to prevent slippage of feet and means to attach said non-slip means to said top surface.

5. A foot rest for use with a toilet, said toilet comprising a bowl and a base on which said bowl rests, said foot rest composed of light-weight, plastic material, said foot rest comprising:

an inverted trough comprising:

a top surface having two extremities and a middle, said top surface sloping downward from said middle towards each of said extremities; and two side walls connected to said top surface, said side walls having an outward taper from top to bottom;

said trough having a generally U-shaped cross-section, said trough further being hollow with an open bottom and shaped to define a generally U-shaped opening for receiving said base, said opening being sufficiently large so that said foot rest may be moved relative to said base when said opening so receives said base, and so that said foot rest may be so moved to a position substantially completely under said toilet; and non-slip surface coverings attached to said top surface;

said foot rest being slidably adjustable during use of said toilet.

* * * * *